United States Patent [19]

Nakazawa et al.

[11] Patent Number: 4,674,619

[45] Date of Patent: Jun. 23, 1987

[54] PASSENGER CONVEYOR

[75] Inventors: Hayashi Nakazawa, Katsuta; Shouichi Nakao, Mito; Cyuichi Saito; Makoto Kawagoshi, both of Katsuta, all of Japan

[73] Assignees: Hitachi, Ltd.; Hitachi Elevator Engineering Ltd., both of Tokyo, Japan

[21] Appl. No.: 768,313

[22] Filed: Aug. 22, 1985

[30] Foreign Application Priority Data

Aug. 22, 1984 [JP] Japan ..... 59-173291
Mar. 8, 1985 [JP] Japan ..... 60-44873

[51] Int. Cl.[4] ..... B66B 23/06
[52] U.S. Cl. ..... 198/331; 198/336
[58] Field of Search ..... 198/330, 331, 326, 335, 198/336, 332

[56] References Cited

U.S. PATENT DOCUMENTS 4,175,653 11/1979 Kubota et al. ..... 198/332
4,200,177 4/1980 Sato et al. ..... 198/335

FOREIGN PATENT DOCUMENTS 54-102774 8/1979 Japan ..... 198/336

*Primary Examiner*—Joseph E. Valenza
*Attorney, Agent, or Firm*—Antonelli, Terry & Wands

[57] ABSTRACT

A passenger conveyor including body frame is formed of a main frame including upper and lower horizontal sections and an inclined section therebetween, and upper and lower auxiliary frames mounted on the upper and lower horizontal sections of the main frame, respectively. A front side of the upper auxiliary frame and the upper horizontal section forms a recessed portion, and a driving device for driving handrail is provided in the recessed portion so that the handrail driving device is positioned over the surface of the upper horizontal section and the width of the passenger conveyor is reduced without changing the height of the handrail driving device. The lower auxiliary frame and the inclined section of the main frame also form a recessed portion and a tension device is disposed in the recessed portion so as to be disposed over the main frame, whereby the passenger conveyor is reduced in width by 100–150 mm.

9 Claims, 7 Drawing Figures

PASSENGER CONVEYOR

BACKGROUND OF THE INVENTION

This invention relates to a passenger conveyor such as a moving stairway, a moving walkway or the like, and, more particularly, to a passenger conveyor in which a construction of a body frame and a handrail driving device is improved for saving space of a building, etc.

In general a passenger conveyor comprises two kinds of moving bodies, that is, steps attached to continuously circulating endless belt or chain, and a pair of handrails which are symmetrically disposed on the sides of the steps so as to circulate and assist the passengers. The moving bodies, handrail driving devices, etc. are mounted on the body frame which is installed between the floors for entry and exit. The body frame has upper and lower chords as main frames, and the handrail driving device is mounted on the upper chord in a lateral relation.

Recently, there has been a demand to reduce the size of a passenger conveyor and, in particular, to reduce the overall width of the conveyor without reducing the transportation capacity, and without causing any problems or disadvantages. The whole width of the passenger conveyor includes the width of the steps, the body frame and the handrail driving device, and the distance between the body frame and an outer or side panel covering the body frame, the handrail driving device, and so on and is generally between 1.5–1.7 m. While it is most effective for spacesaving reasons to reduce the whole width of the passenger conveyor, such width reduction, however, is very difficult since the width of the steps can not be reduced in view of the transportation capacity; therefore, improvements on width reduction are directed to the remaining width other than the step width.

In order to achieve a width reduction of passenger conveyors, several proposals have been made such as, for example, the proposals contained in Japanese Patent Publication No. 56-38503/1981 and Japanese Patent Laid-Open Application No. 57-141379/1982.

In Japanese Patent Publication No. 56-38503, a handrail driving device is disposed over a body frame made of a truss. In this construction, a deck and side panel covering the handrail driving device, the body frame, etc, is necessary to be elevated to a fairly high position to accommodate the handrail driving device. Since the handrail has a certain constant height to enable a gripping by a passenger, and the deck and outer or side panel covering the inside construction are non-transparent. When the deck is too high, the transparent portion of the balustrade is relatively small and, disadvantageously, the aesthetics afforded by the provision of transparent portions is not provided.

In, for example, Japanese Laid Open Application No. 57-141379/1982, a handrail driving device is proposed wherein an upper chord, which is one of a main frame construction of a body frame of a truss construction, is cut off by a length to provide opposite ends, between which a part of the upper chord is cut off, and the handrail driving device is inserted into the cut off portion, that is, between the opposite cut ends of the upper chord and is welded to the opposite cut ends of the chord. In this construction, the upper chord is disposed within the handrail driving device with respect to the width direction so that the whole width of the passenger conveyor is reduced. However, a disadvantage of this construction resides in the fact that the strength of the body frame decreases because the portion of the upper chord, designed to bear the large load, is removed, and thermal strains, caused by welding, are introduced into the body frame and the handrail driving device.

An object of the invention is to provide a passenger conveyor having an reduced width and capable of saving space.

In accordance with the present invention an upper surface of the body frame of a passenger conveyor is recessed in a vicinity of a boundary between a horizontal upper face portion and the inclined upper surface portion of the body frame so as to provide a recess suitable for accommodating a handrail driving device, and the handrail driving device is disposed in the recess so that the handrail driving device is positioned over the body frame at the recess whereby the whole width of the passenger conveyor is reduced.

According to further features of the invention, the body frame is made of a main frame having upper and lower horizontal sections and an inclined section interposed between the upper and lower horizontal sections, and two auxiliary frames respectively disposed on the upper and lower horizontal sections, with each integrated auxiliary frame and horizontal section of main frame forming a machine room therein and the recess is formed by a front end of the upper auxiliary frame and the upper horizontal section.

DETAILED DESCRIPTION

Figure 1:
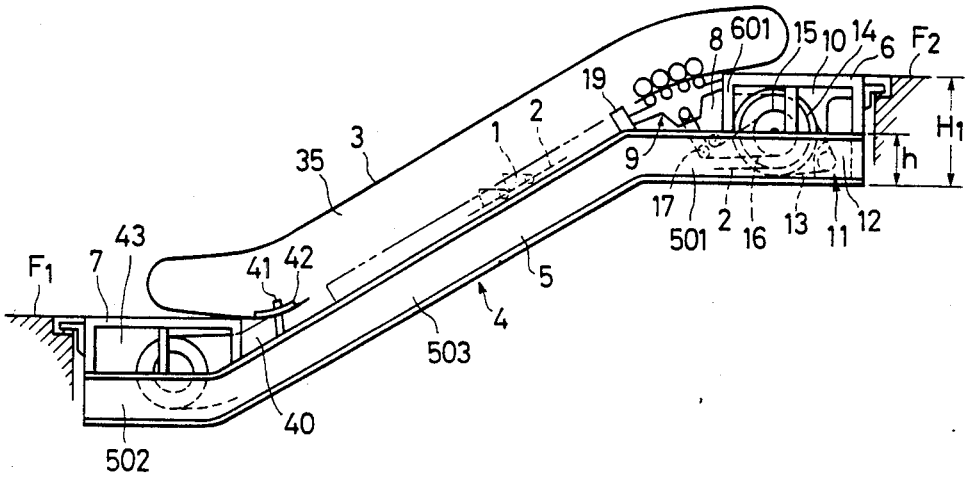
FIG. 1 is a side view of an embodiment of a passenger conveyor according to the present invention.

Referring now to the drawings wherein like reference numerals are used throughout the various views to designate like parts and, more particularly, to FIG. 1, according to this figure, a passenger conveyor includes moving steps 1 attached to a continuously circulating endless chain belt 2, and a pair of handrails 3, with the passenger conveyor extending, for example, between a first and second floor $F_1$, $F_2$ of a building. The moving steps 1 and chain belt 2 are mounted on a body frame 4 which includes a main frame 5, an upper auxiliary frame 6, and a lower auxiliary frame 7, with the main frame 5 having substantially the same height h over an entire length thereof, and including an upper horizontal section 501, and a lower horizontal section 502 and an inclined section 503.

The upper auxiliary frame 6 is of a box-like framework and is fixedly mounted on the upper horizontal section 501 of the main frame 5 so that the upper surface of the body frame 4 is recessed, that is, a part of the horizontal section 501 and front face of the upper auxiliary frame form a recess or space 8 for accommodating a handrail driving device 9 near a boundary between the upper horizontal section 501 and the inclined section 503 of the main frame 5. The main frame 5 and the upper auxiliary frame 6 form an integrated frame portion whose height $H_1$ is the same as a conventional apparatus and on which a floor plate is mounted.

The integrated frame portion has the same level as the second floor $F_2$ and forms therein a machine room 10 for accommodating machinery 11, with the machinery 11 including a driving apparatus 12 for driving a chain 13, a driving wheel 14, driven by the chain 13 and driving the endless chain belt 2 to which the steps are attached, and a driving chain wheel 15 engaged with a chain 16 for transmitting a driving force to the handrail driving device 9 via idle wheels 17.

Figure 2:
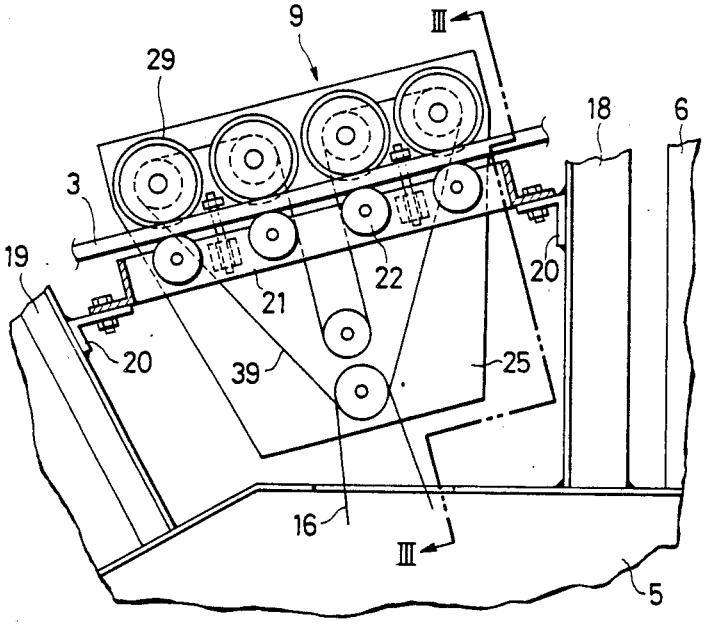
FIG. 2 is an enlarged side view of a part of FIG. 1.
Figure 3:
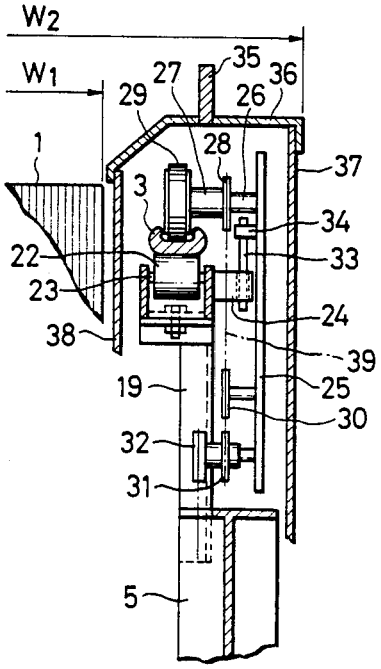
FIG. 3 is a sectional view taken along a line 3—3 of FIG. 2.

As shown in FIG. 2, the handrail driving device 9 is disposed in the recess or space 8, and is mounted on standing bars or members 18, 19 secured to the main frame 5 by welding so as to extend upwardly from the surface of the main frame 5, with brackets 20 being secured to the standing bars 18,19 by welding. On the brackets 20, a frame 21 is fixedly mounted by, for example, a threaded fastener such as a screw, with the frame 21 carrying rollers 22 freely rotatable on pins 23 secured to the frame 21. The handrail driving device 9 further includes a mounting plate 25 having a shaft 26 secured thereto. On the shaft 26, sprocket 28 and driving wheels 29 joined to the sprockets 28 by coaxial shafts 27 are rotatably mounted. A sprocket 30 is rotatably mounted on a shaft secured to the mounting plate 25. Sprockets 31, 32 are secured to each other and are rotatably mounted on a shaft secured to the mounting plate 25. The mounting plate 25 has guide pins 33 secured thereto by brackets 34, with each of the guide pin 33 extending downward and being slidably insertable in an opening formed in a guide member 33 secured to the frame 21 so that the mounting plate 25 is vertically movable and the driving wheel 29 presses the handrail 3 on the roller 22 thereby causing a creation of a frictional force between the handrail 3 and the driving wheel 29. On the sprockets 28, 30, 31, a chain 39 is engaged, with the chain 33 receiving a driving force from the chain 16 and circulating so that the driving wheels 29 are rotated and, as the driving wheels 29 rotate, the handrail 3 circulates.

The handrail 3 is provided along a circumference of the balustrade 35 and circulates therearound. The balustrade 35 is secured to a deck 36 which is secured to outer and inner panels 37, 38, with the panels 37, 38 and the deck 36 surrounding the handrail driving device 9.

The handrails 3, balustrade 35, handrail driving device 9 are each prepared in pairs and are symmetrically arranged with respect to the steps. The handrail driving device 9 is disposed in the recess 8 so that the mounting plate 25 and the main frame 5 are not disposed side by side and the former is disposed right over the latter without changing the height of the deck 36. According to this embodiment the overall width $W_2$ of the passenger conveyor is reduced by 100–150 mm without changing the step width $W_1$, compared with the conventional passenger conveyor in which the handrail driving device and the main frame are arranged side by side. Further the deck 36 is not too high and is the same in height as one of the conventional passenger conveyor. Therefore, when transparent balustrades are used, the aesthetics of transparency is not reduced.

The lower auxiliary frame 7 is fixedly mounted on the lower horizontal section 502 of the main frame 5 to form an integrated frame portion, and the integrated main frame portion forms a machine room in the interior for accommodating machinery such as chain wheels, and the upper surface of the auxiliary frame 7 and the inclined section of the main frame 6 are recessed in the vicinity of the boundary between the lower horizontal and inclined sections 502 and 503 thereby providing a recess 40. In the recess 40, a standing bar 41 is secured to the inclined section 503 by welding so as to project upward from the upper surface and a tension device 42 is connected to the bar 41 so that the tension device 42 and the main frame do not laterally overlap. The tension device 42 provides a tension to the handrail 3 so that the handrail 3 will project outside at both turning ends of the balustrade in the longitudinal direction.

Thus, according to the invention, the total or whole width of the passenger conveyor is reduced by 100–150 mm, and the installation space is reduced.

As the main frame 5, preferably the main frame 5 is, for example, an I-shaped beam having a height (h).

A modification of the handrail driving device 9 is mounting plate or frame **25*a* secured to the standing bar 19 and a standing bar portion 601 of the upper auxiliary frame 6 (see FIG. 1). The mounting plate 25*a* is provided with a boss 251 formed thereby, with the boss 251 rotatably supporting a shaft 27*a* via bearings 252. The shaft has a sprocket 28 at one end and a driving wheel 29 at the other end, with the driving wheel 29 being rotated by a chain 39 engaged with the sprocket 28 and a sprocket 31 coaxially secured to a sprocket 32, with the sprockets 31, 32 being supported by a pin secured to the mounting plate 25*a*. The sprocket 32 is driven by the chain 16 which is driven by the driving apparatus provided in the machine room of the body frame 4. The supporting beam 21 supports the follower 22 through a pin, with the beam 21 having a bracket 24*a* secured thereto to which a vertical pin 33*a* is secured and the pin 33*a* is slidably inserted in holes made in guide members secured to the mounting plate 25*a*. The supporting beam 21 is pressed by a compression spring 45 provided between the beam 21 and a support 20*a* secured to the mounting plate 25*a*, so that the handrail 3 is pressed on the driving roller 29 by the follower 22, whereby the handrail 3 is circulated receiving a rotating force from the driving wheel 29. Thus formed handrail driving device 9*a* is covered with the deck 36 and the outer panel 37**.

The handrail driving device **9*a* and the main frame 5** is not laterally arranged and this construction also reduces the total width $W_3$ by about 100–150 mm.

Figure 5:
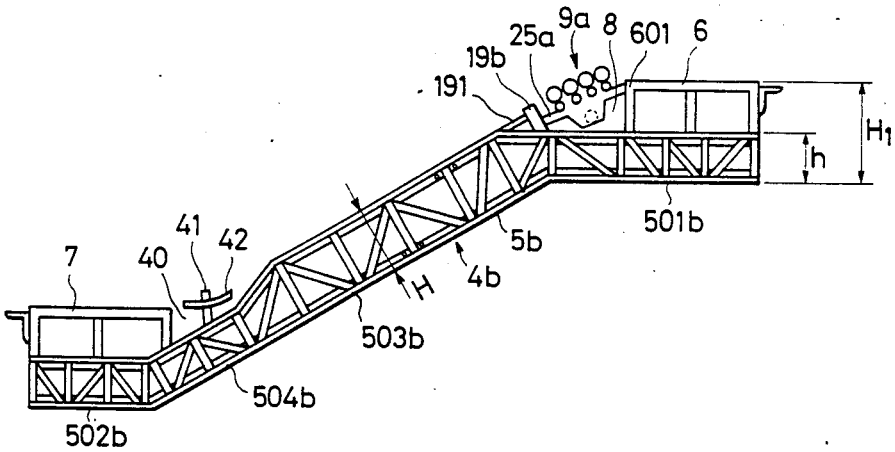
FIG. 5 is a side view of another embodiment of a passenger conveyor according to the present invention.

In FIG. 5, a body frame **4*a* includes a main frame 5*b* and upper and lower auxiliary frame 6 and 7. The main frame 5*b* is made in truss construction and has upper and lower horizontal section 501*b* and 502*b* the height of which is h, and an inclined section 503*b*. The inclined section 503*b* has a portion of height H which is higher than the height h and a portion of height h at the lower region. The upper and lower auxiliary frames 6, 7 are rigidly mounted on the upper and lower horizontal sections 501*b* and 502*b*, respectively, so as to form integrated upper and lower frame portions each of which has height $H_1$ higher than the height H or h and form therein machine rooms similar to the embodiment of FIG. 1. The upper and lower auxiliary frames 6 and 7** serve to mount thereon a floor plate for the entry or exit and to install the passenger conveyor on the floors $F_1$ and $F_2$.

Figure 4:
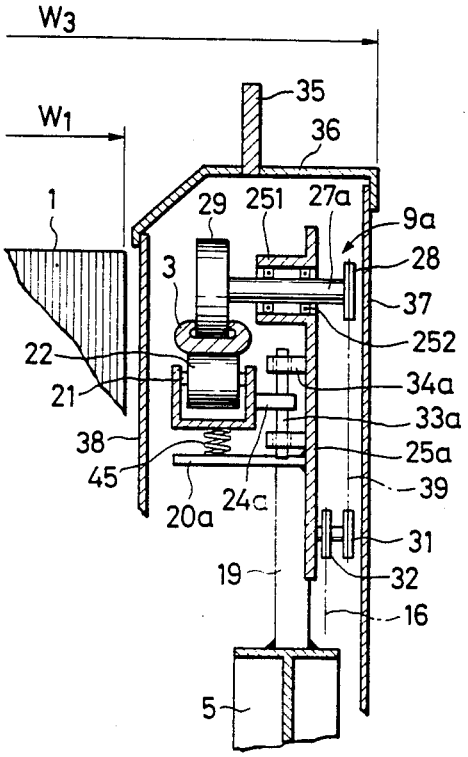
FIG. 4 is a sectional view of modification of a passenger conveyor shown in FIGS. 1–3.

The upper auxiliary frame 6 and the upper horizontal section 501*b* of the main frame 5*b* form an upper recess or space 8 which is substantially the same as in FIG. 1. In the recess 8, a handrail driving device 9*a* which is the same as shown in FIG. 4 is disposed and secured to a standing bar 19*b* secured to the frame 5*b* so as to stand and the standing bar portion 601 of the upper auxiliary frame 6, by the mounting plate or frame 25*a* of the device 9*a*. The standing bar 19*b* is supported by a stay member 191 at the upper portion.

Figure 6:
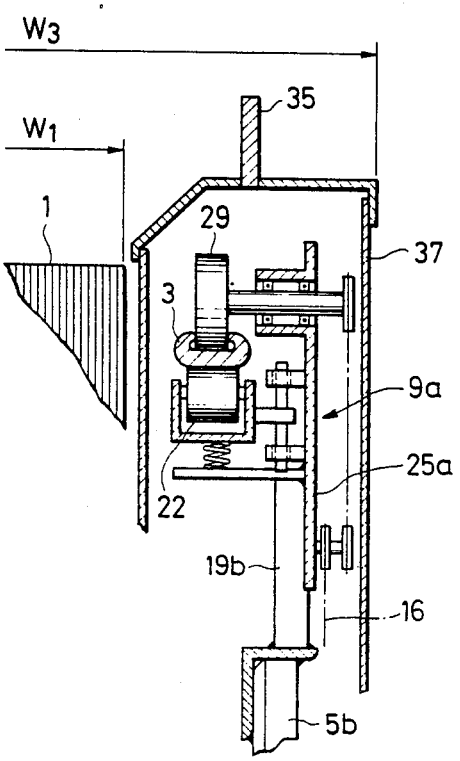
FIG. 6 is an enlarged sectional view of a handrail driving device shown in FIG. 5.

As shown in FIG. 6, the handrail driving device 9*a* is disposed over the main frame 5*a* and is secured to the main frame 5*a* through the standing bar 19*b*. And the handrail driving device 9*a* is covered with the deck and the outer panel. The total width $W_3$ of the passenger conveyor also is reduced by 100–150 mm without changing the sufficient width $W_1$ of the passage for passengers.

Referring back to FIG. 5, the lower auxiliary frame 7 and the lower partion 504*b* of the inclined section 503*b* of the main frame 5*b* form a recess 40 for installing a tension device 42. The tension device 42 is connected to a standing pole 41 secured to the upper surface of the main frame 5*b* so that the tension device 42 including the standing pole 41 is not arranged laterally of the main frame 5*b*. The tension device 42 also is accommodated within the side pannel 37 the width of which is reduced by 100–150 mm.

Figure 7:
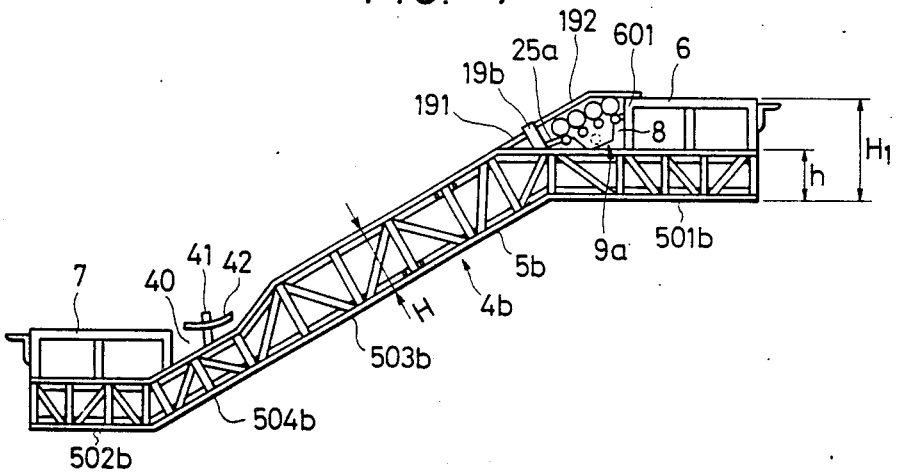
FIG. 7 is a side view of further another embodiment of a passenger conveyor according to the present invention.

The embodiment of FIG. 7 is the same as in FIGS. 5 and 6 except that a reinforcing member 192 is provided. The reinforcing member 192 is fixedly mounted on the upper portion of the standing bar 19*a* and the upper auxiliary frame 6 so as to span the handrail driving device 9*a*.

In all the above-mentioned embodiments, the height $H_1$ of integrated frame portion is, for example, about 1 m, and the height (h) of the horizontal section of the main frame is about one half of $H_1$ or less, for example, 470 mm.

What is claimed is:

1. A passenger conveyor comprising:

a body frame;

a plurality of steps supported by said body frame, said steps being connected together and mounted on said body frame to circulate in an endless manner;

a pair of handrails disposed on opposite sides of said steps; and handrail driving devices each of which is mounted on said body frame and drives said handrail to circulate at substantially the same speed as the speed of said steps;

wherein said body frame is formed of a main frame including an upper and lower horizontal section and an inclined section, and upper and lower auxiliary frames respectively mounted to said upper and lower horizontal sections, said upper auxiliary frame being disposed on said upper horizontal section so as to provide for an exposed upper surface portion of said horizontal section on a side of said inclined section;

a recessed portion for accommodating said handrail driving devices defined by said exposed upper surface portion of said upper horizontal section of said main frame and a front side of said upper horizontal section; and wherein each of said handrail driving devices is disposed in said recessed portion so as to be positioned over said main frame.

2. A passenger conveyor as defined in claim 1, wherein each of said upper and lower auxiliary frames is a box-like framework having thereon an upper portion mounting a floor plate and therein a machine room in cooperation with a part of said upper horizontal section of said main frame.

3. A passenger conveyor as defined in claim 1, wherein each of said handrail driving devices includes a fixed frame secured to a standing member provided on said main surface so as to project upwardly from an upper surface of said main frame; followers rotatably mounted on said frame and supporting said handrail; a mounting member engaged with said frame so as to be movable perpendicularly to a running direction of said handrail; and driving wheels rotatably mounted on said mounting member and driving said handrail to circulate, said handrail being sandwiched between said driving wheels and said followers.

4. A passenger conveyor as defined in claim 2 wherein said main frame is formed in a truss construction, said inclined section of said main frame is lower in height at both end portions of said inclined section and at said upper and lower horizontal sections than in an intermediate portion of said inclined section of said main frame.

5. A passenger conveyor as defined in claim 4, wherein said handrail driving device including a mounting member is fixed to a standing member secured to said main frame and said upper auxiliary frame.

6. A passenger conveyor as defined in claim 5, wherein a reinforcing member is fixed to said standing member and said upper auxiliary frame so as to span said handrail driving device.

7. A passenger conveyor comprising: a main frame including upper and lower horizontal sections and an inclined section between said upper and lower horizontal sections;

upper and lower auxiliary frames mounted on said upper and lower horizontal section of said main frame, respectively, thereby providing a body frame, said upper auxiliary frame, having a front side in an upper horizontal portion mounting thereon a floor plate, and being disposed on said upper horizontal section so as to leave an exposed part of the upper side of said upper horizontal section between said front side of said auxiliary frame and said inclined section of said main frame;

a recessed portion of said body frame defined by said front side of said auxiliary frame and said exposed upper side of said upper horizontal section of said main frame;

steps attached to an endless chain and supported by said body frame;

a driving apparatus, supported by said body frame for driving said chain so as to endlessly circulate said steps;

a pair of balustrades each disposed on opposite sides of said steps and supported by said body frame;

a pair of handrails each provided so as to circulate along the circumference of said balustrade; and handrail driving devices each for driving said handrail driving device said handrail driving devices being inserted in said recessed portion and fixed to said main frame through a standing member secured to the upper surface of said main frame.

8. A passenger conveyor as defined in claim 7, wherein said lower auxiliary frame and a lower portion of said inclined section of said main frame defined a recessed portion and a tension device for imparting tension to said handrail is positioned in said recessed portion.

9. A passenger conveyor as defined in claim 8, wherein said main frame is formed in a truss construction and said upper and lower auxiliary frames are of frameworks, said standing member is reinforced by a reinforce member provided so as to span said handrail driving device.

* * * * *